US008033315B2

(12) United States Patent
Herzog

(10) Patent No.: US 8,033,315 B2
(45) Date of Patent: Oct. 11, 2011

(54) CASTING TOOL

(75) Inventor: Ivo Herzog, Gerlingen (DE)

(73) Assignee: Herzog & Herzog Holding und Service GmbH, Gerlingen (DE)

( * ) Notice: Subject to any disclaimer, the term of this patent is extended or adjusted under 35 U.S.C. 154(b) by 66 days.

(21) Appl. No.: 12/590,242

(22) Filed: Nov. 4, 2009

(65) Prior Publication Data

US 2010/0236746 A1 Sep. 23, 2010

(30) Foreign Application Priority Data

Mar. 17, 2009 (DE) ..... 10 2009 014 567

(51) Int. Cl.
*B22C 17/00* (2006.01)

(52) U.S. Cl. ..... 164/213; 164/219

(58) Field of Classification Search ..... 164/213, 164/219

See application file for complete search history.

(56) References Cited

U.S. PATENT DOCUMENTS

| | | | |
|---|---|---|---|
| 3,096,547 | A | 7/1963 | Hunter et al. |
| 3,556,195 | A | 1/1971 | Lund |

FOREIGN PATENT DOCUMENTS

| | | |
|---|---|---|
| DE | 1 433 981 | 2/1970 |
| DE | 1 921 048 | 2/1970 |
| DE | 101 14 712 C1 | 10/2002 |
| DE | 101 14 714 C1 | 10/2002 |

*Primary Examiner* — Jessica L Ward
*Assistant Examiner* — Nicholas P D'Aniello
(74) *Attorney, Agent, or Firm* — Flynn, Thiel, Boutell & Tanis, P.C.

(57) ABSTRACT

A casting tool for the production of castings, particularly cores for sand castings, pressure die-castings, and gravity die-castings is provided. The casting tool has a casting tool unit with a casting mold half having a mold recess the contour of which partly defines the shape of the casting, and an ejecting assembly disposed on that side of the casting mold half which faces away from the mold recess. The ejecting assembly has an ejecting rod which extends through an access bore into the mold recess in the casting mold half. An entrainer unit is attached to the ejecting assembly. The entrainer unit and a contact surface provided on the casting tool unit jointly define the maximum distance of the casting tool unit from the ejecting assembly.

7 Claims, 7 Drawing Sheets

CASTING TOOL

TECHNICAL FIELD AND PRIOR ART

The invention relates to a casting tool for the production of castings, in particular, cores for sand castings, pressure die castings and gravity die castings.

Generic casting tools have a plurality of different basic units capable of being moved relatively to each other in the direction of a uniform axis of motion for performing different functions.

These basic units primarily include a first and a second casting tool unit. These casting tool units each have at least one casting mold half comprising at least one mold recess, and sections of each of the two mold recesses define the contour of the casting to be produced and jointly define the total contour of said casting, preferably in the closed state of the casting tool. The two casting tool units are guided for movement relatively to each other in the direction of a Z-axis for the purpose of opening and closing the casting tool.

Another unit that is usually provided is an ejecting assembly, which is likewise guided for movement in the direction of the Z-axis relatively to the first of the two casting tool units. This ejecting assembly is provided on that side of the first casting tool unit that faces away from the first mold recess of the first casting mold half and it comprises at least one ejecting rod which can be inserted through an access bore in the first casting mold half until it enters the first mold recess. Such an ejecting assembly, which usually comprises a plurality of ejecting rods jointly movable in the direction of the Z-axis, serves to eject the solidified casting following the formation thereof. For this purpose, the ejecting assembly is moved relatively to the first casting tool unit in such a way that the at least one ejecting rod is inserted into the first mold recess and the casting previously produced therein is thus pressed out of said first mold recess.

With generic casting tools, a similar design is frequently found on the opposite side of the casting tool in the form of a leveling unit. This leveling unit is disposed on that side of the second casting tool unit that faces away from the second mold recess. Like the ejecting assembly, the leveling unit is also guided for movement in the direction of the Z-axis relative to the second casting tool unit. During the production of sand castings, the leveling unit serves the purpose of pressing down the sand remaining in access bores of the second casting mold half following the sand shooting procedure and before the sand casting is subsequently solidified with the aid of a gas treatment. As in the ease of the ejecting assembly, the leveling unit thus comprises at least one leveling rod positioned in an access bore in the second casting mold half. This leveling rod can also perform the supplementary function of an ejector and can be inserted into the second mold recess of the second casting mold half for the purpose of removing the casting from said second casting mold half. As in the case of the ejecting assembly, a plurality of jointly movable leveling rods is preferably included in the leveling unit.

Usually, the leveling unit is used alternately with a nozzle unit. Sand is shot into the mold cavity of the closed casting mold by means of the nozzle unit, the sand through the access bores that are also used for the leveling rods. Once the mold recess is completely filled with sand, the nozzle unit is removed and replaced by the leveling unit which presses the sand in the access bores down in the manner described above and optionally assists the removal of the solidified sand casting from the second mold recess following the gas treatment.

The units described above, that is to say, the first casting tool unit, the second casting tool unit, the ejecting assembly and the leveling unit/nozzle unit are moved relatively to each other in the direction of the Z-axis during operation.

Usually, in the case of the casting tools known from the prior art, the components described above are guided together in the direction of the Z-axis. Thus guiding means are usually provided with the aid of which the ejecting assembly disposed on the first casting tool unit is guided in the direction of the Z-axis. Furthermore, guiding means are usually provided by means of which the leveling unit/nozzle unit is guided relatively to the second casting tool unit in the direction of the Z-axis.

In addition to the guiding devices, interacting means are also provided in the known generic tools, which interacting means restrict the degree of movement of the basic units relatively to each other.

Interacting means are thus usually provided which set a maximum distance between the first casting tool unit and the ejecting assembly. Due to the action of such interacting means, the ejecting assembly can only be located at a distance from the first casting tool unit that ensures that the distal ends of the ejecting rods are flush with the contour of the first mold recess in the first casting mold half in the first casting tool unit. This is the position of the ejecting rods during the casting process. A distance going beyond the spacing between the ejecting assembly and the first casting tool unit is not required and is prevented by the interacting means.

Furthermore, interacting means are usually provided between the second casting tool unit and the ejecting assembly, by means of which interacting means the ejecting assembly is held at a distance from the second casting tool unit when the casting tool is closed, that is to say, when the casting mold halves are brought together such that the ejecting rods are forcefully withdrawn from the first mold recess of the first casting mold half in the first casting tool unit to assume the position described above during the casting process.

Furthermore, interacting means are usually also provided in a similar manner between the first casting tool unit and the leveling unit. When the casting mold is closed by pushing together the casting mold halves, these interacting means force the leveling rods to be withdrawn from the mold recess of the casting mold in a manner similar to the ejecting rods.

The guiding and interacting means described above and as are provided between the different basic units take up considerable installation space. This is seen to be problematic, since the casting tool has to be substantially larger than the actual casting mold due to these guiding and interacting means.

Another disadvantage of the prior systems is that the adaptation of the casting tool to varying casting mold halves involves the adaptation of a plurality of guiding means or interacting means. This problem particularly occurs when the casting mold halves are not replaced, but instead are post-machined. As a result of such post-machining, the dimension of the respective casting mold halves in the direction of the Z-axis is reduced so that the casting tool units have to be drawn closer together in order to close the casting mold. In order to prevent this from causing an incorrect arrangement of the ejecting rods and/or leveling rods during the casting operation, the interacting means must likewise be adjusted accordingly. This adaptation procedure is cumbersome and error-prone.

OBJECT OF THE INVENTION AND ITS ACHIEVEMENT

It is an object of the invention to develop a casting tool of the generic kind to the effect that it is designed to be compact and easy to handle in terms of its adaptability to various casting mold halves.

In accordance with a first aspect of the invention, this object is achieved by a casting tool as defined in claim 1. The basic units of this casting tool include at least the first casting tool unit described above and the ejecting assembly described above that is guided for movement relatively to the first casting tool unit in the direction of the Z-axis. In the form of interacting means, an entrainer is attached to the ejecting assembly, to which entrainer a contact surface of the first casting tool unit is assigned such that the entrainer and the contact surface jointly define the maximum distance of the first casting tool unit from the ejecting assembly.

The characterizing feature of the invention is that the contact surface is provided on a spacing element, which is removable and/or can be adjusted in terms of its dimension in the direction of the Z-axis with the aid of an adjusting device and which is attached to the first casting tool unit and extends away from the ejecting assembly in the direction of the Z-axis.

During operation of the casting mold in accordance with its intended use, the contact surface is in a fixed position in relation to the other parts of the first casting tool unit. Together with the entrainer that is stationary relative to the ejecting assembly, the contact surface restricts the freedom of movement of the first casting tool unit and the ejecting assembly relative to each other. This maximum distance is made adjustable by the design of the invention. This adjustability is achieved by a spacing element, which is attached to the first casting tool unit and is replaceable and/or adjustable due to its removability in order to adjust the position of the contact surface relative to the first casting tool unit and thus, in particularly, relative to the first mold recess of the first casting tool unit. Starting from the first casting tool unit, the aforementioned spacing element extends in the direction facing away from the ejecting assembly. This arrangement makes it possible to increase the maximum distance of the first casting tool unit from the ejecting assembly by shortening the spacing element such that the contact surface is displaced toward the ejecting assembly. Such an increase in the maximum distance is particularly necessary when the first casting mold half has been post-machined and its dimension in the direction of the Z-axis has therefore been reduced. In the absence of any additional adjustments, the displacement of the first mold recess in the direction of the ejecting assembly caused by this post-machining would result in the at least one ejecting rod being constantly present, at least in part, within the first mold recess on completion of such post-machining and the shape of the casting to be produced being unintentionally influenced.

The solution proposed by the invention is advantageous particularly over the conventional measure of increasing the length of the interacting means between the ejecting assembly and the first casting tool unit, since the enlargement of a component is naturally more difficult to achieve than the reduction thereof, for example, by grinding.

The aforementioned spacing element can be attached by, say, a screw connection to the first casting tool unit, particularly to a base plate of the first casting tool unit. It can therefore be removed by loosening the appropriate screws and then shortened or replaced by a shorter spacing element. A spacing element that is adjustable in terms of its length and thus in terms of the position of the contact surface may be permanently connected to the first casting tool unit.

In a development of the invention, the second casting tool unit described above comprising a second casting mold half and the leveling unit are also provided as additional units. A spacing element is attached to the leveling unit, which spacing element is arranged such that it interacts with the spacing element pertaining to the first casting tool unit, preferably with the assistance of the entrainer, such that the leveling rod is driven out of the second mold recess when the casting mold halves are closed.

This design thus provides cooperation of the spacing element pertaining to the leveling unit with the spacing element pertaining to the first casting tool unit, according to which the leveling rods are driven out of the second mold recess when the casting mold is closed. The spacing elements of the first casting tool unit and the leveling unit cooperate for this purpose in such a way that they set the minimum distance between the first casting tool unit and the leveling unit.

The special advantage arising from the use of the spacing element pertaining to the first casting tool unit as described above is that the change in length, as explained above, of the spacing element attached to the first casting tool unit at the same time brings about a change in said minimum distance between the first casting tool unit and the leveling unit. When the first spacing element is thus shortened or replaced by a shorter one, this is accompanied by a reduction of the minimum distance between the first casting tool unit and the leveling unit. This reduction in the minimum distance following post-machining or a replacement of the first casting mold half is advantageous since this change in the dimension of the first casting mold half in the direction of the Z-axis involves displacement of the second casting mold half of the second casting tool unit. The at least one leveling rod has accordingly to be drawn closer to the first casting tool unit in the closed state of the casting tool after post-machining the first casting mold half so that the distal end of the leveling rod is aligned flush with the second mold recess of the second casting mold half during operation. This is made possible by reducing the minimum distance between the first casting tool unit and the leveling unit, which reduction is achieved by shortening the spacing element pertaining to the first casting tool unit.

A modification of the spacing element pertaining to the first casting tool unit is likewise accompanied by an increase in the maximum distance between the first casting tool unit and the ejecting assembly and a reduction of the minimum distance between the first casting tool unit and the leveling unit. Both results are necessary after post-machining the first casting mold half.

In this development of the invention, it is not strictly necessary for the spacing element pertaining to the first casting tool unit and that of the leveling unit to be able to come directly into contact with each other. Instead, provision may be made for the spacing element pertaining to the leveling unit to establish direct contact with the entrainer of the ejector unit which in turn rests against the spacing element pertaining to the first casting tool unit.

A spacing element is preferably also attached to the second casting tool unit. The spacing element is disposed such that it interacts with the entrainer so that the ejecting rod is moved out of the first mold recess when the casting mold halves are closed.

This principle, which is known per se, can be used particularly advantageously as a development of the embodiment described above. Due to the fact that the position of the entrainer relative to the first casting tool unit can be adjusted by a modification of the spacing element pertaining to the first casting tool unit, there is no need to effect any additional change in the length of the spacing element pertaining to the second casting tool unit when there is a change in the dimension of the first casting mold half in the direction of the Z-axis, for example as a result of post-machining of the first casting mold half. The spacing element pertaining to the second casting tool unit defines the minimum distance between the second casting tool unit and the ejecting assembly. This minimum distance, which ensures that the ejecting rods are removed from the mold recess in the closed state of the casting mold, need not be adjusted when there is a change in the first casting mold half in terms of its dimension in the direction of the Z-axis. Since the minimum distance is only determined by the spacing element pertaining to the second casting tool unit and the position of the entrainer, it is not affected by a change in the spacing element pertaining to the first casting tool unit.

In a development of the invention, the spacing element pertaining to the first casting tool unit is in the form of a hollow cylinder and the entrainer is attached to a guide member mounted on the ejecting assembly and guided within the spacing element pertaining to the first casting tool unit.

By virtue of this design, the interacting means in the form of the entrainer and the spacing element pertaining to the first casting tool unit can also at the same time form space-saving guiding means, with the aid of which the ejecting assembly is guided in the direction of the Z-axis relatively to the first casting tool unit. The spacing element pertaining to the ejecting assembly is thus guided in the direction of the Z-axis within the preferably peripherally closed cylindrical hollow spacing element pertaining to the first casting tool unit or within a bore in a base plate of the first casting tool unit, which bore is aligned with the cylindrical hollow spacing element pertaining to the first casting tool unit. Since provision need not be made for any separate guiding means and interacting means to effect cooperation between the ejecting assembly and the first casting tool unit, a particularly compact design is achieved. The cylindrical hollow shape of the spacing element pertaining to the first casting tool unit additionally gives rise to a comparatively large contact surface provided peripherally on the end face of the spacing element pertaining to the first casting tool unit. The entrainer has an extension, which extends transversely to the Z-axis and prevents the guide member pertaining to the ejecting assembly from sliding out of the spacing element pertaining to the first casting tool unit. The entrainer is preferably designed such that it rests against the contact surface on the end face of the cylindrical hollow spacing element over the total circumference thereof.

In accordance with a second aspect of the invention, the casting tool is embodied as defined in claim 5. The units of this casting tool include the first and second casting tool units described above and the ejecting assembly guided for movement relatively to the first casting tool unit in the direction of the Z-axis and the leveling unit guided for movement relatively to the second casting tool unit in the direction of the Z-axis.

The leveling unit is guided relatively to the second casting tool unit with the aid of a leveler-guiding device in the direction of the Z-axis. Furthermore, spacing elements are each mounted on the second casting tool unit and the ejecting assembly, and these spacing elements interact to the effect that the ejecting rod is moved out of the first mold recess of the first casting mold half when said casting mold halves are closed.

The characterizing feature of the invention is that the spacing element of the second casting tool unit is in the form of a hollow cylinder and encompasses a space, in which a guide member attached to the leveling unit can move in the direction of the Z-axis.

With this design, the spacing element pertaining to the second casting tool unit, whose primary purpose is to move the ejecting rods disposed on the opposite side out of the first mold recess of the opposite first casting mold when the casting mold is closed, is also implemented as part of the leveler-guiding device in that the guide member attached to the leveling unit is movable inside said spacing element pertaining to the second casting tool unit. The arrangement of the guide member pertaining to the leveling unit thus cooperates with the spacing element pertaining to the second casting tool unit and/or with the bore disposed in a base plate of the second casting tool unit flush with said spacing element pertaining to said second casting tool unit such that the second casting tool unit and the leveling unit are not movable relatively to each other transversely to the Z-axis. They thus jointly form the leveler-guiding device.

In the simplest case, guidance is achieved by mutually adjusted diameters of the cylindrical hollow spacing or the bore aligned therewith on the one hand and the guide member on the other. Additional elements may also be provided, such as a dedicated sliding sleeve mounted in the cylindrical hollow spacing.

The design described above is advantageous with regard to the creation of a compact tool since there is no need to provide a spacing element in the second casting tool unit together with guiding means for guiding the leveling unit relatively to the second casting tool unit. Instead, these two functions are performed by the cylindrical hollow spacing element pertaining to the second casting tool unit and the guide member pertaining to the leveling unit.

The cylindrical hollow spacing element pertaining to the second casting tool unit can have a closed end so that the guide member pertaining to the leveling unit cannot come into contact with the first casting tool unit or the ejecting assembly. A design seen to be advantageous, however, is one in which the guide member attached to the leveling unit also forms a spacing element, which spacing element cooperates with a spacing element attached to the first casting tool unit to the effect that the leveling rod is moved out of the second mold recess of the second casting mold half when the casting mold halves are closed.

With such an embodiment, the guide member pertaining to the leveling unit performs a dual function. In addition to the guiding function described above, it also performs an interacting function. For this purpose, the cylindrical hollow spacing element pertaining to the second casting tool unit is open at its end such that the spacing element pertaining to the leveling unit can come into contact with the first casting tool unit or with the ejecting assembly, particularly the entrainer pertaining thereto, through the spacing element pertaining to the second casting tool unit. The contact with the spacing element pertaining to the first casting tool unit, as can be achieved directly or indirectly via the entrainer pertaining to the ejecting assembly, ensures that the leveling unit is displaced relatively to the second casting tool unit in the direction of the Z-axis when the casting mold is closed so that the at least one leveling rod is moved out of the mold recess in the second casting tool unit and thus assumes that position relative to the second casting tool unit which is required for the leveling and gas treating operations.

In accordance with a third aspect of the invention, the casting tool is as defined in claim 7. The units of this casting tool likewise include the first and second casting tool units described above and the ejecting assembly guided for movement relatively to the first casting tool unit in the direction of the Z-axis, and the leveling unit guided for movement relatively to the second casting tool unit in the direction of the Z-axis.

The ejecting assembly is guided in the direction of the Z-axis relatively to the first casting tool unit with the aid of an ejector-guiding device. Furthermore, the first casting tool unit and the leveling unit spacing element each include a spacing element, which spacing elements cooperate with each other to the effect that the at least one leveling rod is moved out of the second mold recess in the second casting mold half when the casting mold halves are closed.

The characterizing feature of the invention with respect to this embodiment is that the spacing element pertaining to the first casting tool unit is in the form of a hollow cylinder and encompasses a space in which a guide member attached to the ejecting assembly can move in the direction of the Z-axis.

This contributes to the creation of a compact mold. The guide member pertaining to the ejecting assembly is accommodated within the spacing element pertaining to the first casting tool unit and thus forms, together with this spacing element, the guiding device.

As in the case of the corresponding design of the leveler-guiding device, this measure contributes to the creation of a particularly compact tool.

The guide member attached to the ejecting assembly preferably forms a spacing which can cooperate with a spacing element provided in the second casting tool unit to the effect that the ejecting rods are moved out of the first mold recess in the first casting mold half when the mold halves are being closed. The guide member thus not only serves to guide the ejecting assembly in the direction of the Z-axis, but also itself forms interacting means making it possible to move the ejecting rods out of the first mold recess in the first casting mold half when said casting mold is being closed.

In accordance with a fourth and final aspect of the invention, the casting tool of the invention is embodied as defined in claim 9. Such a casting mold comprises at least two of the aforementioned casting tool units. These two units are guided for movement relatively to each other in the direction of a Z-axis. A functional surface, which is in a fixed position relative to the respective unit during operation, is assigned to each of the two units, the two functional surfaces being designed and disposed for the purpose of cooperating to define a minimum distance or a maximum distance of the two units from each other.

The characterizing feature of this embodiment is that at least one of the functional surfaces is associated with an adjusting device with the aid of which the position of this functional surface can be adjusted in the direction of the Z-axis relatively to the unit to which it is assigned.

The two functional surfaces in the two units are provided for delimiting the distance of the two units from each other during operation, that is to say, during the use of the casting tool in accordance with its intended use. This can involve setting the minimum distance between the units, for example, setting the maximum degree of approach of the leveling unit, and thus of the leveling rod, toward the first casting tool unit in order to prevent the leveling rod from protruding into the mold recess during operation when the mold is closed. It can also involve setting the maximum distance between the units, for example in order to prevent the ejecting assembly from being spaced from the first casting tool unit more than is necessary in order to position the distal end of the at least one ejecting rod of the ejecting assembly such that it is flush with the contour of the first mold recess. The functional surfaces are preferably provided for delimiting the minimum or maximum distance between the units in that they directly abut each other when the minimum or maximum spacing is reached. However, embodiments are also conceivable in which the functional surfaces cooperate with each other via an interposed section of an additional unit, for example, the interposed entrainer pertaining to the ejecting assembly already explained above.

By means of the adjusting device, the functional surface, which is in a fixed position relative to the respectively assigned unit during operation, can be displaced in the direction of the Z-axis to effect changes in the minimum or maximum distance of the units from each other. Such changes may be necessary if there has been a replacement of one or both of the casting molds in the first and second casting tool units. Such a change may also be necessary, in particularly, when one of the casting mold halves has been post-machined and its dimension in the direction of the Z-axis has thus changed.

For the purposes of the invention, the term "adjusting device" is understood to mean a mechanism which makes displacement of one of the functional surfaces possible without necessitating a replacement of the functional surface itself or of the components supporting the functional surface. The adjusting device preferably allows for continuous displacement of the functional surface in the direction of the Z-axis. This is particularly advantageous when a mold half has been post-machined, since such post-machining results in a variable change in the dimension of the relevant casting mold half in the direction of the Z-axis. Preferably, securing means are provided in order to secure a setting against unwanted self-displacement.

The adjusting device preferably causes the displacement of the functional surface relatively to the assigned unit in the direction of the Z-axis with the aid of an internal male/female thread combination. Such thread-wise adjustment is easy to achieve and is reliable. A lock nut is preferably provided as such securing means.

Some options for implementation of the design of the invention using an adjusting device for displacement of a functional surface are given below, and the invention also relates to the possibility of providing more than one adjusting device, these being assigned to different functional surfaces, so that such adjusting devices can consequently make it possible to adjust the casting tool to set a plurality of maximum distances and/or minimum distances between the casting tool units.

In a first embodiment, the two functional surfaces are assigned to the first casting tool unit on the one hand and the ejecting assembly on the other and they jointly set the maximum distance of the ejecting assembly from the first casting tool unit. This maximum distance is preferably adjusted in such a way that, in the case of a maximum distance of the ejecting assembly from the first casting tool unit, an end face of an ejecting rod is flush with the contour of the first mold recess and thus ensures that the casting obtains the desired shape in the region of the access bore assigned to said ejecting rod. If a modification of the first casting mold half has taken place, for example, by post-machining, by means of which the first mold recess has been shifted in the direction of the Z-axis toward the ejecting assembly, the maximum distance of the ejecting assembly from the first casting tool unit must be increased. This increase can be readily achieved with the aid of the adjusting device of the invention. It is particularly preferred for this adjusting device to be assigned to the functional surface of the first casting tool unit.

In a second embodiment, the functional surfaces are assigned to the first casting tool unit on the one hand and to the second casting tool unit or the leveling unit on the other hand, and they jointly set the minimum distance of the second casting tool unit or the leveling unit from the first casting tool unit. The correct setting of this minimum distance makes it possible, in particular, to prevent the protrusion of the leveling rod into the second mold recess in the closed state of the casting mold. An adjustment of said minimum distance is particularly necessary when the second casting mold half has been post-machined and its dimension in the direction of the Z-axis has consequently been reduced. It is seen to be particularly advantageous for the adjusting device provided for this purpose to be assigned to the functional surface of the first casting tool unit.

In a third embodiment, the functional surfaces are assigned to the second casting tool unit on the one hand and the first casting tool unit or the ejecting assembly on the other hand, and they jointly set the minimum distance of the first casting tool unit or the ejecting assembly from the second casting tool unit. The current setting of this minimum distance ensures, in particular, that when the casting mold is being closed, the ejecting rod is totally removed from the first mold recess, since, when the casting mold is being closed, the functional surface of the second casting tool unit, in particular presses on that pertaining to the ejecting assembly to cause a displacement of the ejecting rod. An adjustment of this minimum distance will be necessary particularly when the second casting mold half has been post-machined and has thus a reduced dimension in the direction of the Z-axis. In such a case, the minimum distance can be readily reduced with the aid of the adjusting device. It is seen to be particularly preferable for the adjusting device provided for this purpose to be assigned to the functional surface of the second casting tool unit.

BRIEF DESCRIPTION OF THE DRAWINGS

Additional aspects and advantages of the invention will become apparent from the claims and the following description of preferred exemplary embodiments, which are explained below with reference to the figures, in which:

DETAILED DESCRIPTION OF THE EXEMPLARY EMBODIMENTS

Figure 1:
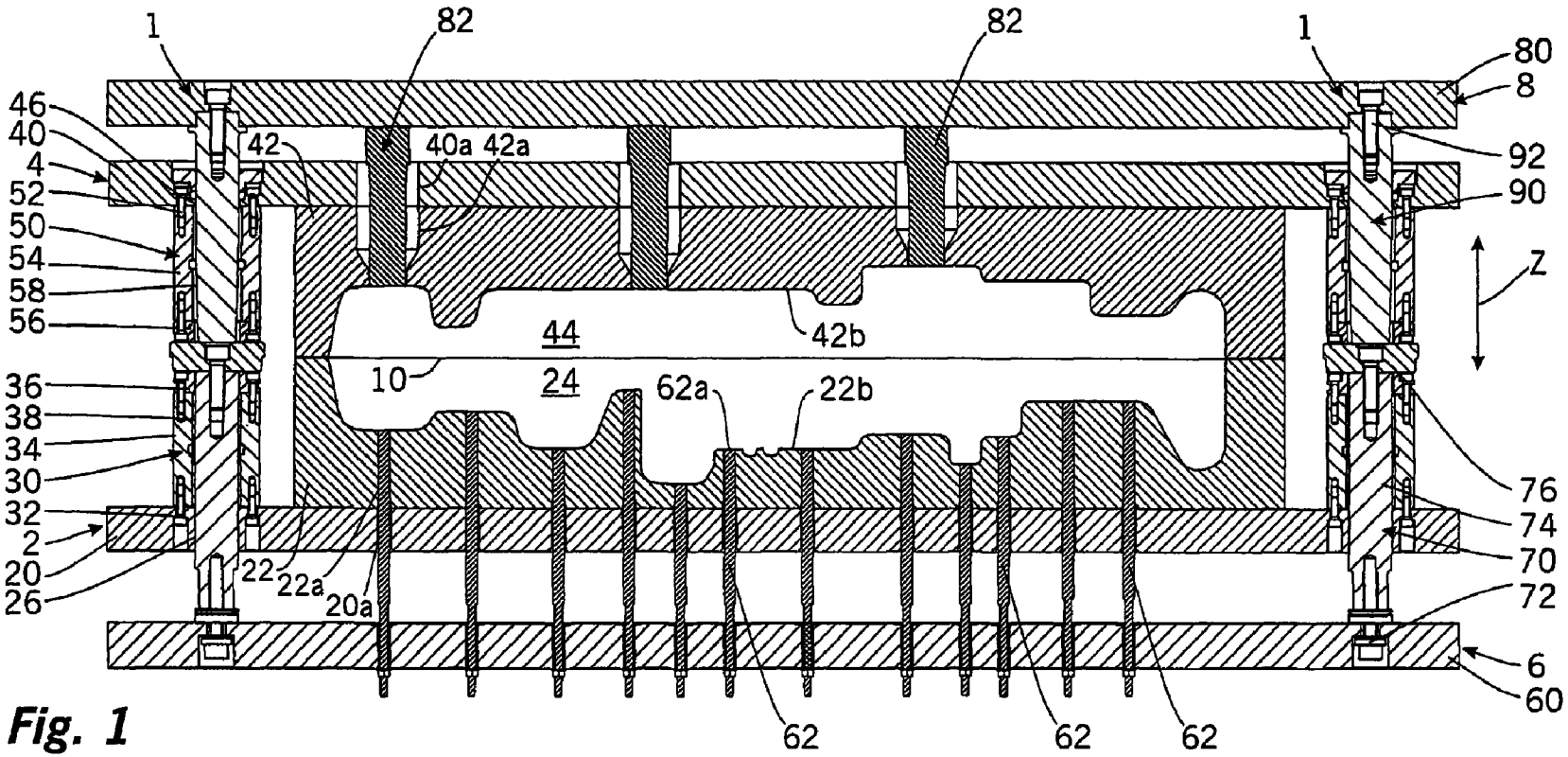
FIG. 1 is a cross-sectional view of the casting tool of the invention.

FIG. 1 shows a casting tool of the invention, which serves to produce cores for sand castings. The basic mode of operation of such a tool is as follows: Sand is shot into a mold cavity formed by two casting mold recesses in two mold halves, which sand completely fills said mold cavity and is thus distributed according to the shape of said mold cavity. The nozzles used for shooting in the sand are then withdrawn from their bores in the top casting mold half and replaced by leveling rods which press the sand remaining in these bores down into the mold cavity. The sand in said mold cavity is subsequently gas-treated such that the grains of sand are bonded together to form a single solid body. Once this has taken place, the casting tool is opened by separating the two casting mold halves. In doing so, the leveling rods are not displaced when the top casting mold half is raised relatively to the bottom casting mold half so that the leveling rods press the resultant casting down into the bottom casting mold half to prevent the sand core from being entrained by the top casting mold half. As soon as the top casting mold half has been lifted and thus separated from the sand core, the sand core is then also separated from the bottom casting mold half with the aid of ejecting rods inserted into the mold recess such that it can be subsequently readily removed.

The tool shown in FIG. 1 comprises altogether four units 2, 4, 6, 8, which can be moved in the direction of a Z-axis relatively to each other but which do not comprise any internal components that can move relatively to each other in the direction of the Z-axis.

Figure 2:
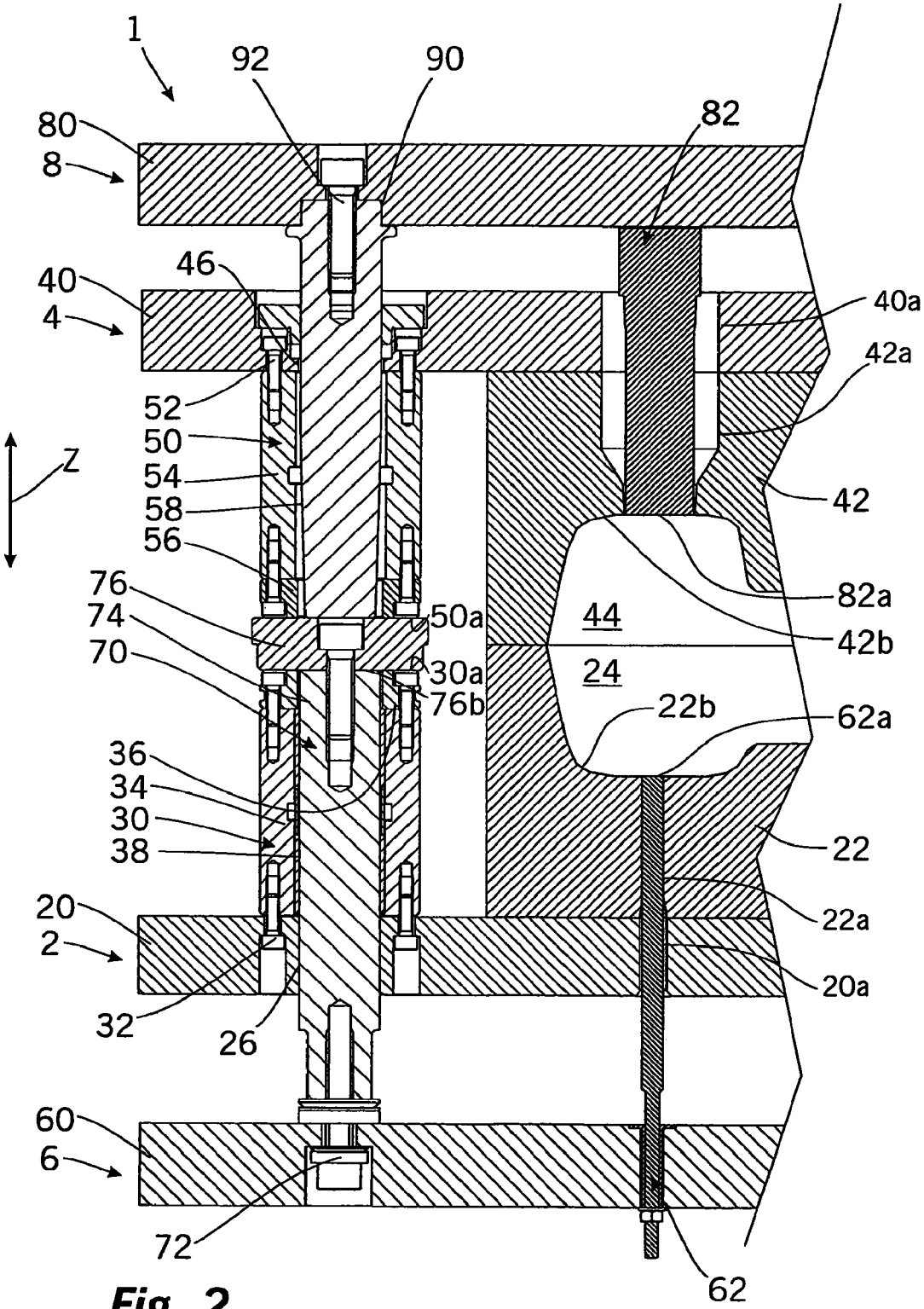
FIG. 2 is an enlarged view of a part of the casting tool shown in FIG. 1, in which a guiding and interacting unit is shown on an enlarged scale.

The four units 2, 4, 6, 8 are coupled to each other in various ways, as will be explained in more detail below, by means of guiding and interacting units 1, of which a total of four are provided in the case of the casting tool illustrated, only two being illustrated in the diagrammatic sectional view shown in FIG. 1. For better understanding, one of the guiding and interacting units 1 is shown in FIG. 2 on an enlarged scale.

The four units 2, 4, 6, 8 each comprise components that are part of the guiding and interacting units 1. This feature will be explained below.

The first unit is the bottom casting tool unit 2. This bottom casting tool unit 2 has a base plate 20 on which a bottom casting mold half 22 is disposed and to which the latter is permanently screwed in a manner not illustrated in detail. In this bottom casting mold half 22 and in the base plate 20, ejector bores 20*a*, 22*a* are provided, each of which extends in the direction of the Z-axis. A mold recess 24, which defines the shape of the sand core to be produced below a mold parting line 10, is formed in the top surface of the bottom casting mold half 22. The two guiding and interacting units 1 are disposed one on each side of the bottom casting mold half 22. A spacing element 30 forming part of these guiding and interacting units 1 is screwed permanently to the bottom casting tool unit 2 by means of screws 32. This spacing element 30 is in the form of a hollow cylinder and comprises a bottom main section 34, to which a tempered end ring 36 is screwed. The gap 38 formed by the hollow cylindrical shape of this first spacing element 30 is aligned with a bore 26 in the base plate 20.

A top casting tool unit 4 is provided as the second unit. The former is designed similarly to the bottom casting tool unit 2 in many respects. The top casting tool unit 4 likewise comprises a base plate 40, to the underside of which a top casting mold half 42 is permanently screwed. A mold recess 44 is formed in the bottom surface of this top casting mold half 42, which mold recess 44 defines, together with the mold recess 24 of the bottom casting mold half 22, the overall shape of the sand core to be produced. Like the ejector bores 22*a* in the bottom casting mold half 22, nozzle injector and leveler bores 42*a* are provided in the top casting mold half 42, which injector and leveler bores merge in the region of the base plate 40 into bores 40*a* aligned therewith. The base plate 40 of the top casting tool unit 4 also is connected to components of the guiding and interacting units 1. Thus, a spacing element 50 is attached to the underside of the base plate 40, which spacing element 50 is permanently connected to the base plate 40 by way of screws 52. This spacing element 50 forms part of the top casting tool unit 4 likewise comprises a main section 54 to which a tempered end section 56 is attached. As in the case of the bottom casting tool unit 2, the gap 58 formed by the hollow cylindrical shape of the spacing element 50 is aligned with a bore 46 provided in the base plate 40.

The third unit of the casting tool illustrated is formed by the ejecting assembly 6. This ejecting assembly 6 also has a base plate 60, ejecting rods 62 extending in the direction of the Z-axis being attached to this base plate 60 in such a way that they move together with the base plate 60 in the direction of the Z-axis. The ejecting rods 62 are disposed and oriented to correspond to the ejector bores 20*a*, 22*a* in the bottom casting tool unit 2. As the installed state illustrated in FIG. 1 shows, the ejecting rods 62 have different lengths and they extend into the bores 20*a*, 22*a*. These different lengths are such that the end faces 62*a* of each of the ejecting rods 62 is flush with the contour 22*b* of the mold recess 24 when the ejecting assembly 6 is in its starting position relative to the bottom casting tool unit 2, as illustrated. As in the case of the base plate 20 and the top base plate 40, the base plate 60 forming part of the ejecting assembly 6 is also permanently connected to components of the guiding and interacting units 1. The base plate 60 in the ejecting assembly has a guiding and spacing element 70 screwed thereto by means of a screw 72. This guiding and spacing element 70 comprises a substantially cylindrical main section 74, whose outside diameter is slightly smaller than the inside diameter of the gap 38 and the bore 26 of the bottom casting tool unit 2. Adjacent to the main section 74 there is provided an entrainer disc 76 connected to the top end thereof by a screwed connection. The diameter of this entrainer disc 76 is larger than the inside diameter of the gap 38 and the bore 26.

The final unit is a leveling unit 8. Unlike the other three units 2, 4, 6, this leveling unit 8 is not a permanent part of the casting tool during the production process of the sand core. It is replaced by a nozzle plate during the sand shooting phase. Corresponding to the other units 2, 4, 6, the leveling unit 8 comprises a base plate 80, on which downwardly extending leveling rods 82 are mounted. These leveling rods 82 are disposed and facing to correspond to the leveler bores 40*a*, 42*a* in the base plate 40 and the top casting mold half 42. Also, as in the case of the other units 2, 4, 6, parts of the guiding and interacting units 1 are permanently connected to said base plate 80. One part is a guiding and spacing element 90 which is attached to the base plate 80 by means of a screw 92. This guiding and spacing element 90 is designed to be substantially cylindrical and has a cross-sectional surface which tapers downwardly only slightly.

The guiding and interacting unit 1 shown on an enlarged scale in FIG. 2 firstly performs guiding functions.

Thus, the cooperation of the guiding and spacing element 90 pertaining to the leveling unit 8 with the sleeve-like spacing element 50 and the bore 46 aligned therewith permits, due to the adjusted diameter thereof, guidance of the leveling unit 8 relatively to the top casting tool unit 4 in the direction of the Z-axis. Movement of the leveling unit 8 relatively to the top casting tool unit 4 is therefore only possible in the direction of said Z-axis and is prevented in the X and Y directions.

Similarly, the guiding and spacing element 70 of the ejecting assembly 6 and the sleeve-like spacing element 30 and the bore 26 of the bottom casting tool unit 2 cooperate to the effect that the bottom casting tool unit 2 and the ejecting assembly 6 can also move only in the direction of the Z-axis relatively to each other, but always remain in a fixed position in relation to each other in the X and Y directions.

In addition to the guiding function described above, the guiding and interacting unit 1 performs the function of setting the minimum distance or maximum distance of the units 2, 4, 6, 8 relative to each other.

The guiding and spacing element 70 thus cooperates with the entrainer disc 76 on the one hand and the spacing element 30 pertaining to the bottom casting tool unit 2 on the other in such a way that the base plate 60 of the ejecting assembly 6 can be displaced downwardly in the direction of the Z-axis relatively to the bottom casting tool unit 2 only to a limited extent. As soon as the underside 76*b* of the entrainer disc 76 rests on the top end face 30*a* of the spacing element 30, it is no longer possible to lower the ejecting assembly 6 further. When the base plate 60 and the ejecting assembly 6 are in this bottom end position relative to the bottom casting tool unit 2, the distal ends 62*a* of the ejecting rods 62 are aligned flush with the contour 22*b* of the mold recess 24.

Furthermore, the spacing element 50 of the top casting tool unit 4 on the one hand and the guiding and spacing element 70 comprising the entrainer disc 76 pertaining to the ejecting assembly 6 cooperate in such a way that they set the minimum distance between the bottom casting tool unit 4 and the ejecting assembly 6. When the casting mold 22, 42 is closed, the ejecting rods 62, as a result of the preset minimum distance, are out of the mold recess 24 and are in the end position shown in FIG. 2. Even if there exists a state prior to the closing operation in which the ejecting assembly 6 is in a raised state relative to the position illustrated in FIG. 2 so that the ejecting rods 62 protrude into the recess 24, closing the casting tool 22, 42 will result in the removal of the ejecting rods 62 therefrom due to the cooperation between the spacing element 50 and the guiding and spacing element 70.

Similarly, the spacing element 30 pertaining to the bottom casting tool unit 2 and the guiding and spacing element 90 pertaining to the leveling unit 8 also cooperate with each other. Operationally connected by means of the entrainer disc 76, the spacing elements 30, 90 jointly define the minimum distance between the bottom casting tool unit 2 and the leveling unit 8. Similarly to the ejecting rods 62, this minimum distance ensures that the leveling rods 82 cannot protrude into the mold recess 44 in its closed state as shown in FIGS. 1 and 2.

Even if, prior to the closing operation, the leveling unit 8 is displaced downwardly relatively to the top casting tool unit 4 in such a way that the leveling rods 82 protrude into the mold recess 44, the closing operation will cause the entrainer disc 76 to bear against the spacing element 30 of the bottom casting tool unit 2 and the guiding and spacing element 70 to rest on the top surface of the entrainer disc 76 so that when the closed state shown in FIGS. 1 and 2 is reached, the distal ends 82*a* of the leveling rods 82 will be aligned flush with the contour 42*b* of the casting mold half 42.

The interactions described above are explained below with reference to a closing operation.

Figure 3B:
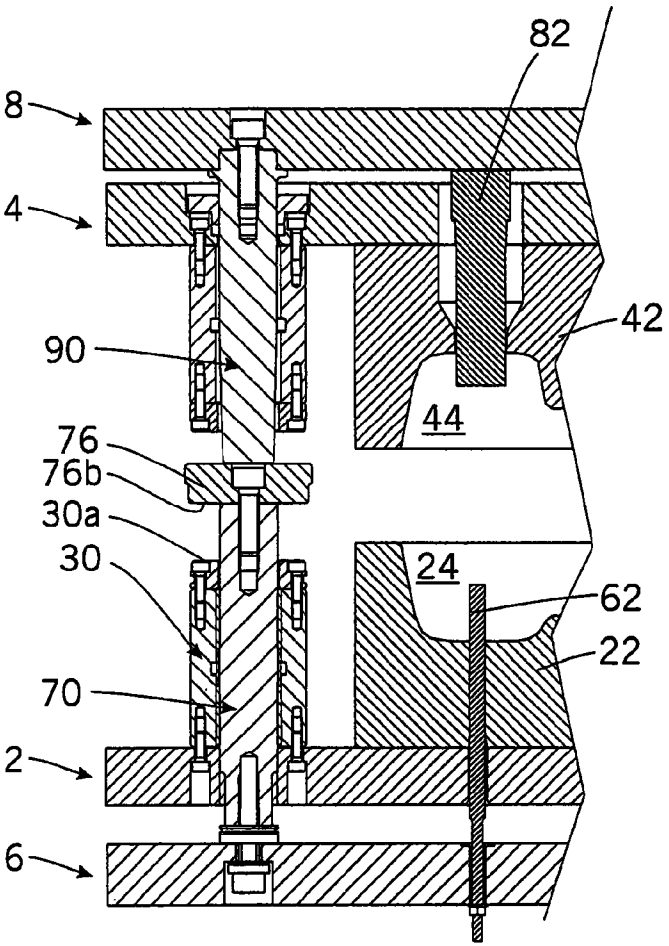
FIGS. 3*a* to 3*d* show the mode of operation of the guiding and interacting unit with reference to a closing operation of the casting mold in the tool shown in FIGS. 1 and 2.
Figure 3A:
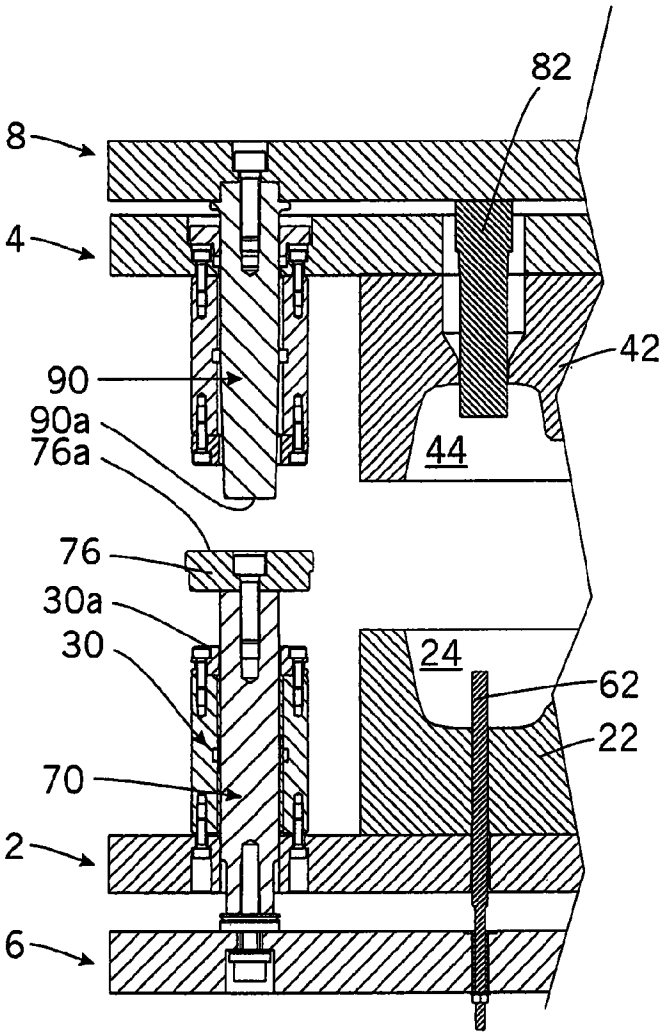

FIG. 3*a* shows an initial state in which the two casting tool units 2, 4 are disposed in such a way that the casting mold halves 22, 42 are at a distance from each other and the casting mold is thus open. The leveling unit 8 guided relatively to the top casting tool unit 4 in the direction of the Z-axis is in a bottom end position relative to the top casting tool unit 4 so that the leveling rods 82 protrude into the mold recess 44. Similarly, compared with the state shown in FIGS. 1 and 2, the ejecting assembly 4 is also in a raised state relative to the bottom casting tool unit 2 so that the entrainer disc 76 no longer rests against the end face 30*a* of the spacing element 30. The result is that the ejecting rods 62 also protrude into the mold recess 24 of the bottom casting mold half 22.

If, proceeding from this initial position shown in FIG. 3*a*, the top casting tool unit 4 and the leveling unit 8 on the one hand are drawn in the direction of the Z-axis closer to the bottom casting tool unit 2 and the ejecting assembly 4 on the other, the bottom end face 90*a* of the guiding and spacing element 90 pertaining to the leveling unit 8 and the top surface 76*a* of the entrainer disc 76 pertaining to the spacing element 70 in the ejecting assembly 6 come into contact with each other. This is illustrated in FIG. 3*b*.

Figure 3D:
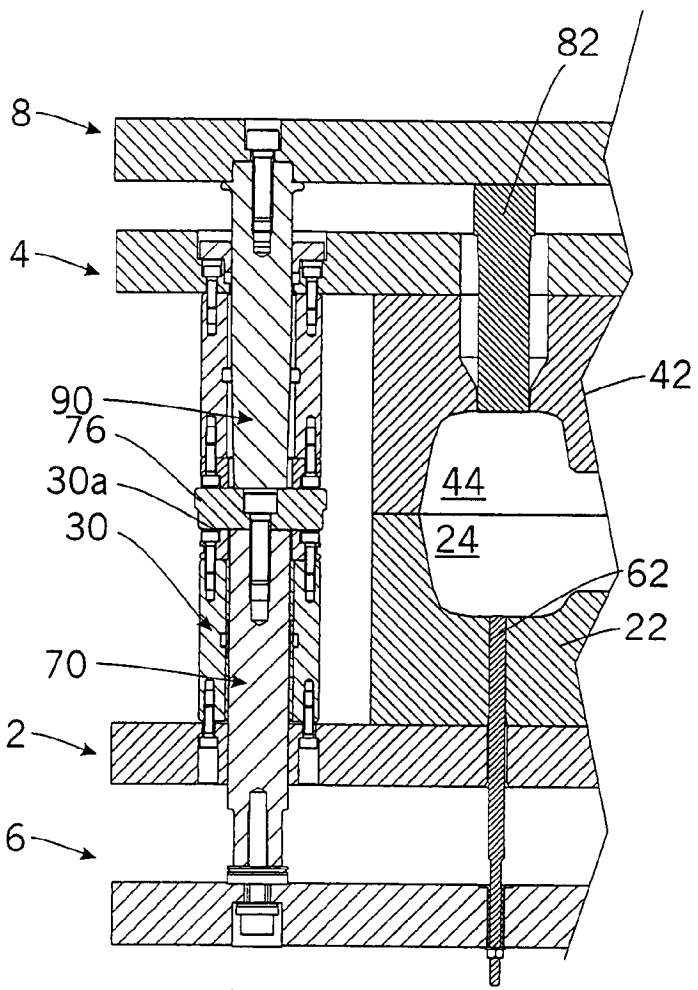
Figure 3C:
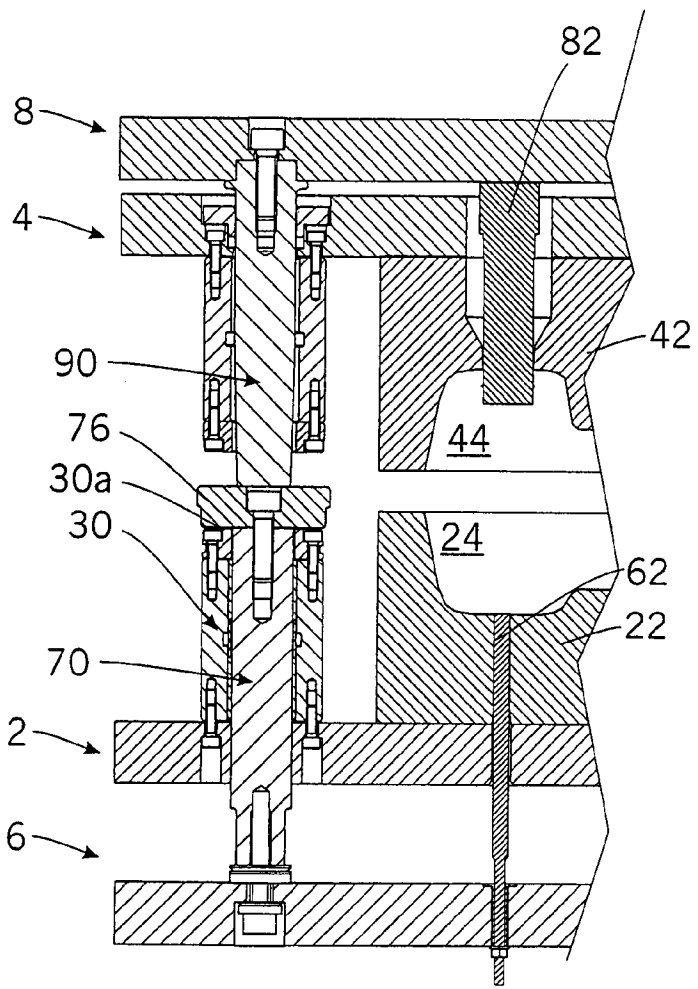

When the top casting tool unit 4 together with the leveling unit 8 further approaches the bottom casting tool unit 2 together with the ejecting assembly 6, the guiding and spacing element 70 and thus indirectly the ejecting assembly 6 will be subsequently displaced downwardly relatively to the bottom casting tool unit with the aid of the entrainer disc 76 until the underside 76*b* of the entrainer disc 76 comes into contact with the end face 30*a* of the spacing element 30 pertaining to the bottom casting tool unit 2. This state is shown in FIG. 3*c*. When this state has been reached, the ejecting rods 62 are no longer inside the mold recess 24, as illustrated in FIG. 2.

As the casting tool units 2, 4 further approach each other, there also results a displacement of the leveling unit 8 relatively to the top casting tool unit 4 since the leveling unit 8 is not able, due to the end face 90*a* of the guiding and spacing element 90, to rest against the top surface 76*a* of the entrainer disc 76 and, due to the fact that the underside 76*b* of the entrainer disc 76 rests against the end face 30*a* of the spacing element 30 member, to continue the movement of the leveling unit 8 relative to the bottom casting tool unit 2 and the bottom ejecting assembly 6. As a result, during this last phase of the closing operation, only the top casting tool unit 4 is moved relatively to the other units 2, 6, 8. This movement ends as soon as the casting mold halves 22, 42 bear flush against each other and the mold recesses 24, 44 thus form a single mold cavity. As a result of the relative movement of the leveling unit 8 relatively to the top casting tool unit 4, the leveling rods 82 are also removed from the mold recess 44 during this phase. The state achieved as a result thereof corresponds to that shown in FIGS. 1 and 2 and is shown again in FIG. 3*d*.

Figure 4A:
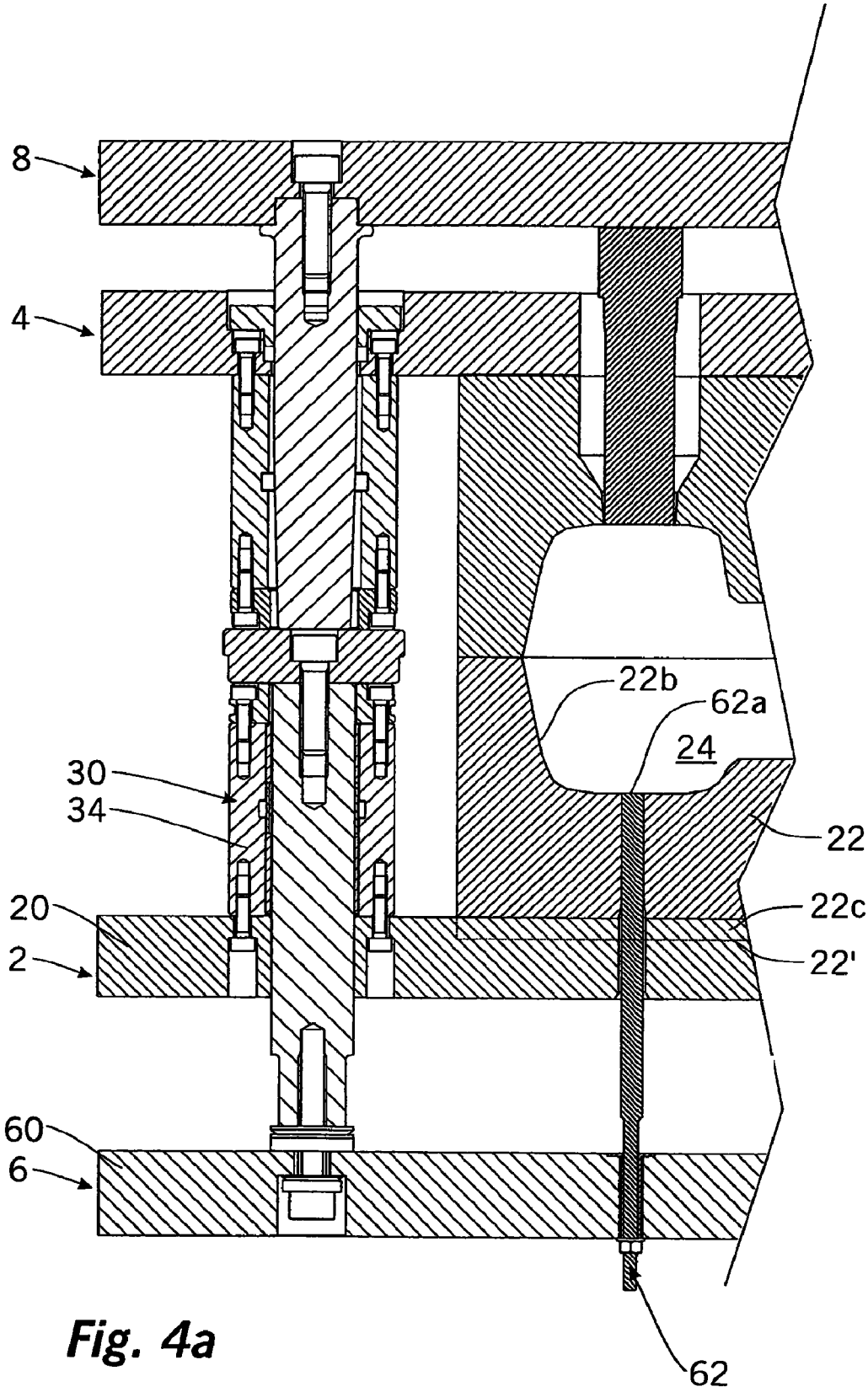
FIG. 4*a* shows an adjusted state of the guiding and interacting unit following post-machining of a bottom casting mold half.
Figure 4B:
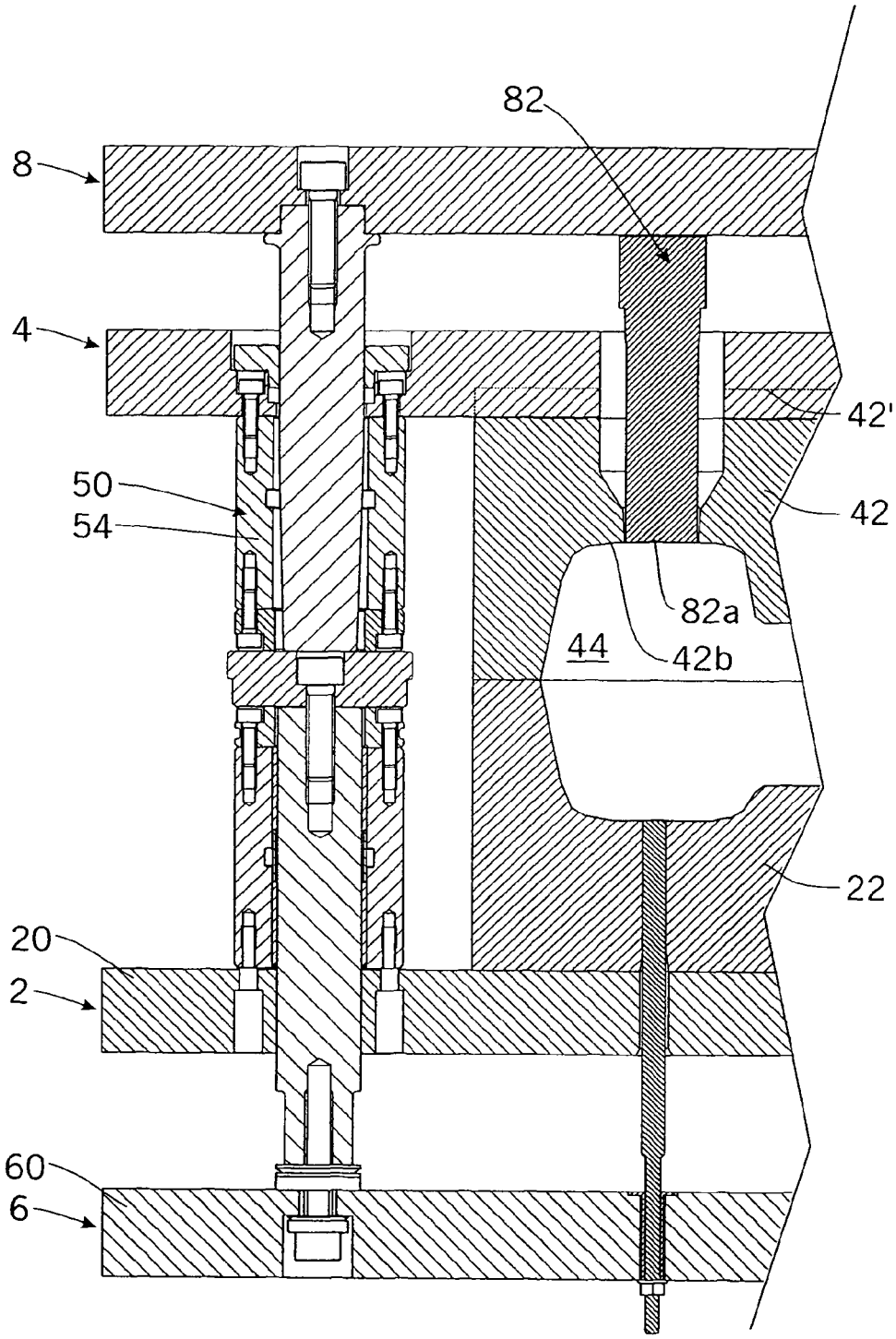
FIG. 4*b* shows an adjusted state of the guiding and interacting unit following post-machining of a top casting mold half.

The illustrated construction of the guiding and interacting units 1 is advantageous particularly in terms of ease of adjustability following post-machining of the casting mold halves 22, 42. FIGS. 4*a* and 4*b* illustrate the adjustments that have to be carried out on the guiding and interacting units 1 when the casting mold halves 22, 42 have been modified in this way.

FIG. 4*a* clarifies this in respect of an adjustment of the bottom casting mold half 22. As is evident from the dashed line 22', a layer 22*c* is ground off from the underside of the bottom casting mold half 22 in this embodiment. On the guiding and interacting unit 1, this change merely necessitates a replacement or shortening of the main section 34 of the spacing element 30. Such a shortened main section 34 is already shown in FIG. 4*a*. The shortening of the main section 34 also results in a shortening of the entire spacing element 30 in the direction of the Z-axis. Accordingly, the maximum distance between the base plates 20, 60 of the units 2, 6 also increases so that the bottom end position of the base plate 60 is spaced from the base plate 20 and the bottom casting mold half 22 to an extent that makes the end faces 62*a* of the ejecting rods 62 again flush with the contour 22*b* of the mold recess 24 without necessitating an additional adjustment for this purpose. At the same time, shortening of the spacing element 30 does not prevent the casting mold halves 22, 42 from closing, because the spacing element 30, the spacing element 50 and the entrainer disc 76 do not prevent the casting tool units 2, 4 from approaching each other to a sufficient extent.

A modification of the bottom casting mold half 22 can thus be compensated by changing only one unit—the main section 34 of the spacing element 30.

Similarly to FIG. 4*a*, FIG. 4*b* shows the adjustment of the guiding and interacting units 1 following post-machining of the top casting mold half 42. In the state shown in FIG. 4*b*, this top casting mold half 42 has reduced thickness similar to the bottom casting mold half 22 in the example shown in FIG. 4*a*. This is illustrated by the dashed line 42'. In order to compensate for this, the spacing element 50 pertaining to the top casting tool unit 4, particularly the main section 54 of the spacing element 50, is shortened. This, in turn, results in a reduction of the minimum distance of the two casting tool units 2, 4, as is determined by the length of the spacing elements 30, 50 and the thickness of the entrainer disc 76, so that it is still possible to close the casting mold 22, 42. The position of the leveling rods 82 in the closed state relative to the unchanged bottom casting mold half 22 does not change since this relative position is determined by the unchanged spacing element 30, the unchanged entrainer disc 76 and the likewise unchanged guiding and spacing element 90. Since the spacing element 50 is shortened to the same extent as the reduction in the dimension of the top casting mold half in the direction of the Z-axis, this unchanged situation of the leveling rods 82 is advantageous since their distal end faces 82*a* are thus again flush with the contour 42*b* of the mold recess 44 in the closed state, as shown in FIG. 4*b*.

The guiding and interacting unit 1 illustrated represents a compact component, which, when provided on a generic tool, performs both the function of guiding the leveling plate and optionally the nozzle plate relatively to the top casting tool unit 4 on the one hand and the ejecting assembly 6 relatively to the bottom casting tool unit 2 on the other. Furthermore, maximum and minimum distances of the different units 2, 4, 6, 8 relative to each other are set by the guiding and interacting unit 1, very little installation space being required for this purpose transversely to the Z-axis due to the integrated design.

The integration of various functions in the guiding and interacting units 1 further makes it possible to adjust the maximum and minimum distances following post-machining of the casting mold halves 22, 42 at low expenditure. A change in the dimension of the casting mold halves 22, 42 in the direction of the Z-axis can be compensated for by a simple adjustment of one of the spacing elements.

Figure 5:
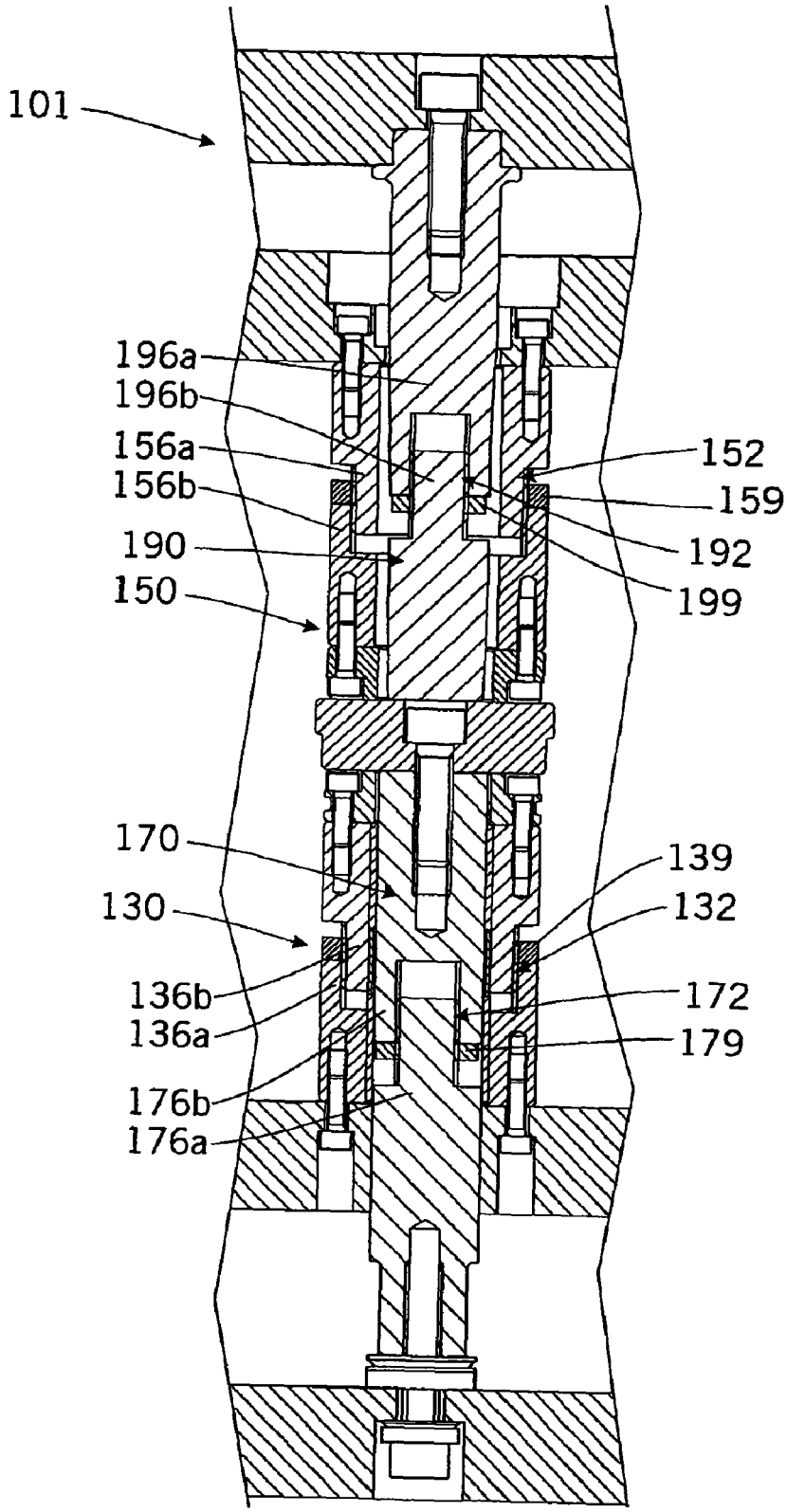
FIG. 5 shows a modified variant of the guiding and interacting unit shown in FIGS. 1 to 4*b* comprising different adjusting devices.

FIG. 5 shows a modified guiding and interacting unit 101. The latter has a similar construction to the guiding and interacting unit 1 described above. Only the differences therein are explained below. In the guiding and interacting unit 101 shown in FIG. 5, adjusting devices 132, 152, 172, 192 are provided on each of the spacing elements 130, 150, 170, 190. These adjusting devices 132, 152, 172, 192 make it possible to vary the distance between any two separate sections 136*a*, 136*b*, 156*a*, 156*b*, 176*a*, 176*b*, 196*a*, 196*b* of the spacing elements 130, 150, 170, 190 with the aid of a male/female thread combination. The distal sections 136*b*, 156*b*, 176*b*, 196*b* can each be displaced axially by a rotational movement about the Z-axis relatively to the respective proximal sections 136*a*, 156*a*, 176*a*, 196*a* in order to adjust the length of the spacing elements 130, 150, 170, 190. Lock nuts 139, 159, 179, 199 are provided in each case, with the aid of which the modified length can be secured following a change in the length setting of the respective spacing element.

The fourfold adjustability in the case of the exemplary embodiment shown in FIG. 5 serves the purpose of illustration only. It is found to be advantageous if only some of these adjusting devices 132, 152, 172, 192 are provided. It is particularly preferred for both of the adjusting devices 132, 152 to be provided on the sleeve-like spacing elements 130, 150 since these makes it possible to readjust the guiding and interacting unit 101 in the manner illustrated in FIGS. 4*a* and 4*b* following post-machining of the bottom and/or top casting tool units.

The invention claimed is:

1. A casting tool for the production of castings, comprising:

a first casting tool unit including a first casting mold half with a first mold recess, the contour of the first mold recess at least partly defining the shape of the casting;

an ejecting assembly disposed on that side of the first casting mold half which faces away from the first mold recess and capable of movement in the direction of a Z-axis relative to said first casting tool unit, the ejecting assembly having at least one ejecting rod which extends through an access bore pertaining to said first casting mold half into said first mold recess; and an entrainer unit attached to said ejecting assembly, wherein a contact surface provided on said first casting tool unit is assigned to the entrainer unit for contacting said entrainer unit, said entrainer unit and said contact surface jointly defining the maximum distance of the first casting tool unit from said ejecting assembly, said contact surface is provided on a releasable and/or adjustable spacing element, the spacing element being adjustable in terms of its dimension in the direction of the Z-axis by means of an adjusting device, the spacing element is attached to said first casting tool unit and extends away from said ejecting assembly in the direction of the Z-axis, the spacing element pertaining to said first casting tool unit and being in the form of a hollow cylinder, and said entrainer unit is mounted on a guide member attached to said ejecting assembly guided inside said spacing element.

2. The casting tool as defined in claim 1 further comprising:

a second casting tool unit including a second casting mold half with a second mold recess, the contour of the second mold recess defining, together with said first mold recess of said first casting mold half in the closed state of said first and second casting mold halves, the shape of the casting; and a leveling unit disposed on that side of said second casting mold half which faces away from said second mold recess in the second casting mold half and capable of moving in the direction of the Z-axis relative to said second casting tool unit, the leveling unit having at least one leveling rod which passes through an access bore in said second casting tool unit into said second mold recess, a second spacing element attached to said leveling unit and disposed such that the second spacing element interacts with said spacing element pertaining to said first casting tool unit with the cooperation of said entrainer unit such that when the first and second casting mold halves are being closed, the leveling rod is pulled out of said second mold recess.

3. The casting tool as defined in claim 2 further comprising a third spacing element attached to said second casting tool unit and disposed such that the third spacing element interacts with said entrainer unit in such a manner that when said first and second casting mold halves are being closed, said ejecting rod is pulled out of said first mold recess.

4. A casting tool for the production of castings, comprising:

a first casting tool unit including a first casting mold half;

a second casting tool unit including a second casting mold half, the first and second casting mold halves being capable of moving in the direction of a Z-axis relative to each other and, said first and second casting mold halves having a first mold recess and a second mold recess respectively, the joint contour of the first and second mold recesses, in the closed state of the first and second casting mold halves, defining the shape of the casting;

an ejecting assembly disposed on that side of the first casting mold half which faces away from said first mold recess and capable of moving in the direction of the Z-axis relative to said first casting tool unit, the ejecting assembly having at least one ejecting rod passing through an access bore pertaining to said first casting mold half into the first mold recess; and a leveling unit disposed on that side of the second mold recess casting mold half that faces away from said second casting mold half recess and capable of moving in the direction of the Z-axis relative to said second casting tool unit, the leveling unit having at least one leveling rod which can pass through an access bore pertaining to said second casting mold half into said second mold recess, said leveling unit being guided by a leveler-guiding device relative to said second casting tool unit in the direction of the Z-axis, wherein a first spacing element is attached to said second casting tool unit and a second spacing element is attached to said ejecting assembly, the first and second spacing elements cooperating in such a manner that the ejector rod is pulled out of the first mold recess of the first casting mold half when the first and second casting mold halves are being closed, and said first spacing element pertaining to said second casting tool unit is in the form of a hollow cylinder and encompasses an accommodating chamber, in which accommodating chamber a guide member attached to said leveling unit moves in the direction of the Z-axis.

5. The casting tool as defined in claim 4, wherein the guide member attached to said leveling unit forms a spacing element which cooperates with a third spacing element attached to said first casting tool unit in such a manner that the leveling rod is pulled out of the second mold recess of the second casting mold half when said first and second casting mold halves are being closed.

6. A casting tool for the production of castings, comprising:

a first casting tool unit including a first casting mold half;

a second casting tool unit including a second casting mold half, the first and second casting mold halves being capable of moving in the direction of a Z-axis relative to each other, said first and second casting mold halves having a first mold recess and a second mold recess respectively, the joint contour of the first and second mold recesses, in the closed state of the first and second casting mold halves, defining the shape of the casting;

an ejecting assembly disposed on that side of the first casting mold half which faces away from the first mold recess and capable of moving in the direction of a Z-axis relative to said first casting tool unit, the ejecting assembly having at least one ejecting rod extending through an access bore pertaining to said first casting mold half into said first mold recess, said ejecting assembly being guided by an ejector guiding device relative to said first casting tool unit in the direction of the Z-axis; and a leveling unit disposed on that side of the second casting mold half which faces away from said second mold recess in said second casting mold half and capable of moving in the direction of the Z-axis relative to said second casting tool unit, the leveling unit having at least one leveling rod which passes through an access bore pertaining to said second casting tool unit into said second mold recess, wherein a first spacing element is attached to said first casting tool unit and a second spacing element is attached to said leveling unit, the first and second spacing elements cooperating with each other in such a manner that said leveling rod is pulled out of the second mold recess pertaining to said second casting mold half when the first and second casting mold halves are being closed, and said first spacing element pertaining to said first casting tool unit is in the form of a hollow cylinder and encompasses an accommodating chamber, in which accommodating chamber a guide member attached to said ejecting assembly moves in the direction of the Z-axis.

7. The casting tool as defined in claim 6, wherein said guide member attached to said ejecting assembly forms a third spacing element which cooperates with the second spacing element attached to said second casting leveling unit in such a manner that the ejecting rod is pulled out of said first mold recess of said first casting mold half when said first and second casting mold halves are being closed.

* * * * *